US010639517B2

(12) United States Patent
Griffin

(10) Patent No.: US 10,639,517 B2
(45) Date of Patent: May 5, 2020

(54) FOOTWEAR HARNESS FOR USER ACTIVITIES

(71) Applicant: Ivan W. Griffin, Kansas City, MO (US)

(72) Inventor: Ivan W. Griffin, Kansas City, MO (US)

( * ) Notice: Subject to any disclaimer, the term of this patent is extended or adjusted under 35 U.S.C. 154(b) by 71 days.

(21) Appl. No.: 15/801,495

(22) Filed: Nov. 2, 2017

(65) Prior Publication Data

US 2019/0126091 A1 May 2, 2019

(51) Int. Cl.
*A63B 21/00* (2006.01)
*A43B 1/00* (2006.01)
(Continued)

(52) U.S. Cl.
CPC ..... *A63B 21/4015* (2015.10); *A43B 1/0081* (2013.01); *A43B 5/18* (2013.01); *A63B 21/4013* (2015.10); *A63B 21/4034* (2015.10); *A63B 23/04* (2013.01); *A63B 21/4043* (2015.10); *A63B 2209/10* (2013.01)

(58) Field of Classification Search
CPC ..... A43B 1/0081; A43B 5/18; A63B 21/0004; A63B 21/00043; A63B 21/00058; A63B 21/00061; A63B 21/00065; A63B 21/00069; A63B 21/00072; A63B 21/00076; A63B 21/00178; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/15; A63B 21/151; A63B 21/152; A63B 21/4001; A63B 21/4011; A63B 21/4013; A63B 21/4015; A63B 21/4023; A63B 21/4025; A63B 21/4027; A63B 21/4039; A63B 21/4041; A63B 21/4043; A63B 23/04; A63B 23/08; A63B 23/085; A63B 23/10; A63B 69/0057; A63B 69/0059;
(Continued)

(56) References Cited

U.S. PATENT DOCUMENTS 1,894,561 A * 1/1933 Guiffre ..... A43B 3/124 36/11
4,355,801 A * 10/1982 Thomsen ..... A63B 21/065 482/105

(Continued)

*Primary Examiner* — Gary D Urbiel Goldner
(74) *Attorney, Agent, or Firm* — Lowenstein Sandler LLP; Jon Wolfsberger

(57) ABSTRACT

A harness to be placed over footwear, the harness including a toe portion to be placed around a toe of the footwear. The toe portion may include a plurality of belts from a sole of the footwear to an upper surface of the footwear. The toe portion may further include coupling points located on a front surface and sides of the toe portion. The harness may include a heel portion to be placed around a heel of the footwear. The harness may include a bottom belt that runs along the sole of the footwear that is to couple the toe portion to the heel portion. The harness may further include top belts that run along the upper surface of the footwear that couple the toe portion to the heel portion.

18 Claims, 8 Drawing Sheets

(51) Int. Cl.
*A43B 5/18* (2006.01)
*A63B 23/04* (2006.01)

(58) Field of Classification Search
CPC ..... A63B 2069/0062; A63B 2209/00; A63B 2209/10; A63B 2225/09; A63B 2225/093
See application file for complete search history.

(56) References Cited

U.S. PATENT DOCUMENTS 4,596,387 A * 6/1986 Roberts ..... A63B 21/4017 24/68 SK
4,728,103 A * 3/1988 Fulton ..... A63B 23/085 482/125
5,100,129 A * 3/1992 Porter ..... A63B 21/0552 482/125
5,338,275 A * 8/1994 Chek ..... A63B 21/0084 441/61
5,689,901 A * 11/1997 Bell ..... A43B 5/18 36/135
5,820,534 A * 10/1998 Vadher ..... A63B 21/055 482/124
6,237,250 B1 * 5/2001 Aguerre ..... A43B 3/122 36/11.5
7,500,324 B1 * 3/2009 Power ..... A43B 13/145 36/132
7,998,041 B1 * 8/2011 Johnson ..... A63B 21/0552 482/124
2003/0192198 A1 * 10/2003 Wright ..... A43B 1/0081 36/7.7
2005/0193588 A1 * 9/2005 Dombowsky ..... A43B 3/16 36/7.5
2006/0196084 A1 * 9/2006 Kos ..... A43B 1/0081 36/128
2006/0265910 A1 * 11/2006 Lampley ..... A43B 5/00 36/132
2008/0016722 A1 * 1/2008 Battaglino ..... A43B 5/00 36/114
2008/0199839 A1 * 8/2008 Fugitt ..... A63B 69/00 434/247
2009/0241381 A1 * 10/2009 Bailar ..... A43B 5/18 36/136
2009/0286661 A1 * 11/2009 Campbell ..... A63B 21/0023 482/124
2010/0050473 A1 * 3/2010 Rosso ..... A43B 3/26 36/97
2010/0317495 A1 * 12/2010 DiGiovanni ..... A63B 21/0552 482/129
2012/0220436 A1 * 8/2012 Zoltak ..... A63B 21/0552 482/129
2013/0014409 A1 * 1/2013 Chouinard ..... A43B 5/08 36/59 R
2014/0171276 A1 * 6/2014 Strachan ..... A63B 21/0557 482/124
2014/0274612 A1 * 9/2014 Pesko ..... A63B 21/0609 482/139
2016/0345656 A1 * 12/2016 Ramirez, II ..... A43B 5/18
2018/0036577 A1 * 2/2018 Leary ..... A63B 21/065
2018/0078813 A1 * 3/2018 Saar ..... A43B 5/18
2018/0200564 A1 * 7/2018 Lee ..... A63B 21/4033

* cited by examiner

FOOTWEAR HARNESS FOR USER ACTIVITIES

TECHNICAL FIELD

The present disclosure is generally related to a physical training device, and is more specifically related to a footwear harness for user activities.

BACKGROUND

Resistance bands are elastic bands that may be used for strength training. Resistance bands are also used in physical therapy to treat muscular injuries by allowing a patient to slowly rebuild muscular strength. Resistance bands may be placed around an extremity of a patient. Then, various exercises may be performed that target particular muscles of the patient. The resistance band may provide additional resistance as the exercises are performed, gradually increasing muscular strength.

BRIEF DESCRIPTION OF THE DRAWINGS

The present disclosure is illustrated by way of examples, and not by way of limitation, and may be more fully understood with references to the following detailed description when considered in connection with the figures, in which.

DETAILED DESCRIPTION

Figure 1:
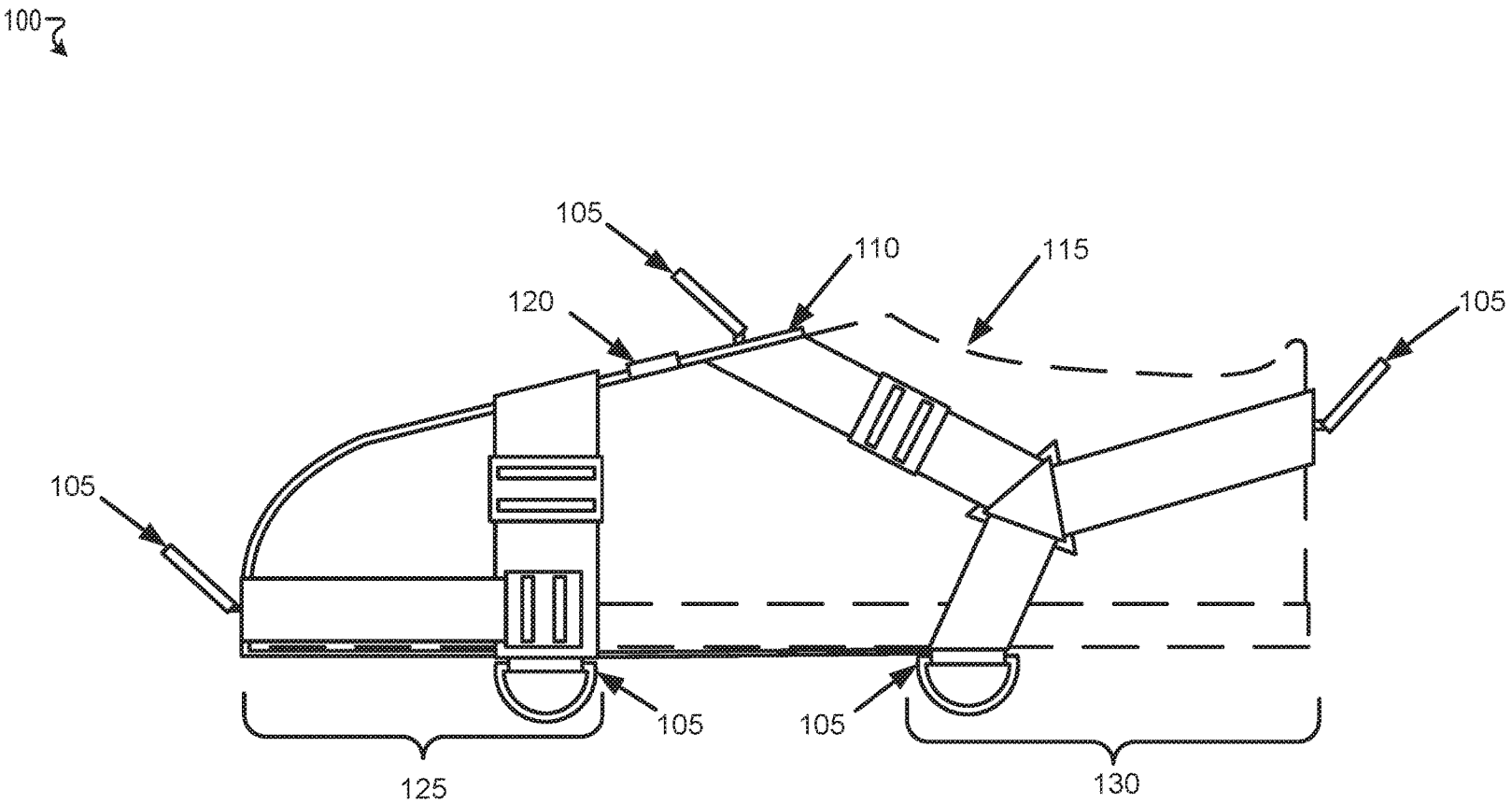
FIG. 1 illustrates a side profile view of footwear harness according to implementations of the present disclosure.

Aspects of the present disclosure relate to a footwear harness for user activities. Activities and exercise may utilize resistance bands. The resistance bands may be elastic bands having various amounts of resistance. Exercises may also be performed using weight machines that include weights attached to a coupling via a series of pulleys.

When a user performs an exercise the user may desire to increase the resistance to improve muscular strength. A resistance band may be used to increase the resistance of the exercise by looping the exercise band around an extremity of a user and then performing the exercise while the user holds the two ends of the resistance band. For example, when a user is performing leg exercises, the user may loop a resistance band around the bottom of their foot while holding the two ends of the resistance band. As the exercise is performed and the resistance band is stretched, the elasticity of the resistance band may provide increased resistance during the exercise. Similarly, resistance bands may be used for physical rehabilitation. For example, if a user has suffered a knee injury, they may wish to gradually increase the strength of the muscles and ligaments in and around the knee by performing exercises targeting the muscles and ligaments while gradually increasing the resistance. This may be done by looping a resistance band around a part of the leg, such as the foot, and performing various rehabilitative exercises that target the knee muscles and ligaments. However, because the resistance band is looped around the user's foot or other extremity it is not secured in place. During the exercise, the resistance band may slide into a new position, which may alter the amount of resistance, change the muscles being targeted by the exercise or make it difficult for the user to perform the exercise. Furthermore, because the resistance band is not secured in place, the resistance band may slip off the foot or extremity of the user during the exercise, which may result in injury or bodily harm. Also, looping the resistance band around the foot of the user may limit the types of exercises that can be performed to exercises having a particular range of motion.

Accordingly, described herein are aspects of a footwear harness for user activities. The footwear harness may include a toe portion that is to be placed around a toe portion of the footwear of a user. The toe portion may include multiple belts to cover the toe of the footwear from a sole of the footwear to an upper surface of the footwear. The toe portion may also include a first coupling point located on a first side of the toe portion, a second coupling point located on a second side of the toe portion and a third coupling point located on a front surface of the toe portion. The footwear harness may also include a heel portion that is to be placed around a heel of the footwear. The heel portion may include multiple belts that cover the heel of the footwear from the sole of the footwear to the upper surface of the footwear. The heel portion may also include a fourth coupling point that is located on the first side of the heel portion, a fifth coupling point that is located on the second side of the heel portion and a sixth coupling point located on a rear surface of the heel portion. The coupling points may provide locations that facilitate the coupling of the footwear harness to a resistance band or other resistance training equipment. The footwear harness may further include a bottom belt that runs along the sole of the footwear that is to couple the toe portion the heel portion and multiple top belts that run along the upper surface of the footwear to couple the toe portion to the heel portion. The top belts may include a seventh coupling point that is above the upper surface of the footwear.

According to aspects of the disclosure, the footwear harness may facilitate different exercises for a wearer of the footwear. The footwear harness may include a toe portion having multiple belts, a heel portion having multiple belts, at least one belt to couple the toe portion to the heel portion and multiple coupling points at different locations on the footwear harness that facilitate different exercises for the wearer of the footwear apparatus.

Thus, the aspects of the present disclosure may be advantageous by providing a harness to be placed over footwear that includes multiple coupling points. The coupling points may be coupled to a resistance band or other type of exercise device. The coupling points may secure the resistance band in a desired location, which may prevent the resistance band from shifting out of place or slipping of the foot of a user, increasing the effectiveness of the exercise being performed by the user and reducing the risk of injury or bodily harm. Furthermore, the multiple coupling points at various locations on the harness may allow the user to perform exercises that could not be performed by looping the resistance band over the foot of the wearer.

FIG. 1 illustrates a side profile view of footwear harness 100 according to implementations of the present disclosure. For illustration purposes, footwear harness 100 is shown as being worn on footwear 115. The footwear harness 100 may include coupling points 105 at various locations on the footwear harness 100. The coupling points 105 may facilitate the coupling of a resistance band or other exercise equipment to the footwear harness 100. In one implementation, the coupling points 105 may be loops. In another implementation, the coupling points 105 may be hooks. In other implementations, the coupling points 105 may be clips. In implementations, coupling points 105 may be any type of fastener that is capable of coupling a resistance band or other exercise equipment to the footwear harness 100. The coupling points 105 may be fabricated from plastic, metal, metal alloys, carbon fiber or other similar materials.

The footwear harness 100 may include top belts 110 that are above an upper surface of the footwear 115. The top belts 110 may include an adjustable buckle 120 that may be used increase or decrease the length of the top belts 110 to allow the footwear harness 100 to fit footwear 115 of various shapes and sizes. The top belts 110 may also include a coupling point 105 positioned on the upper surface of the top belts 110.

The footwear harness 100 may further include a toe portion 125 that covers the toe area of the footwear 115. The toe portion 125 may include multiple belts and adjustable buckles to cover the toe area of the footwear 115, as will be discussed in more detail in FIGS. 2A and 2B. The toe portion 125 may also include coupling points 105 located at the front of the toe portion 125 and the sides of the toe portion 125.

The footwear harness 100 may include a heel portion 130 that covers the heel area of the footwear 115. The heel portion 130 may include multiple belts and couplings to cover the heel area of the footwear 115, as will be discussed in more detail in FIGS. 3A and 3B. The heel portion 130 may also include coupling points 105 located at the rear of the heel portion 130 and the sides of the heel portion 130.

Figure 2A:
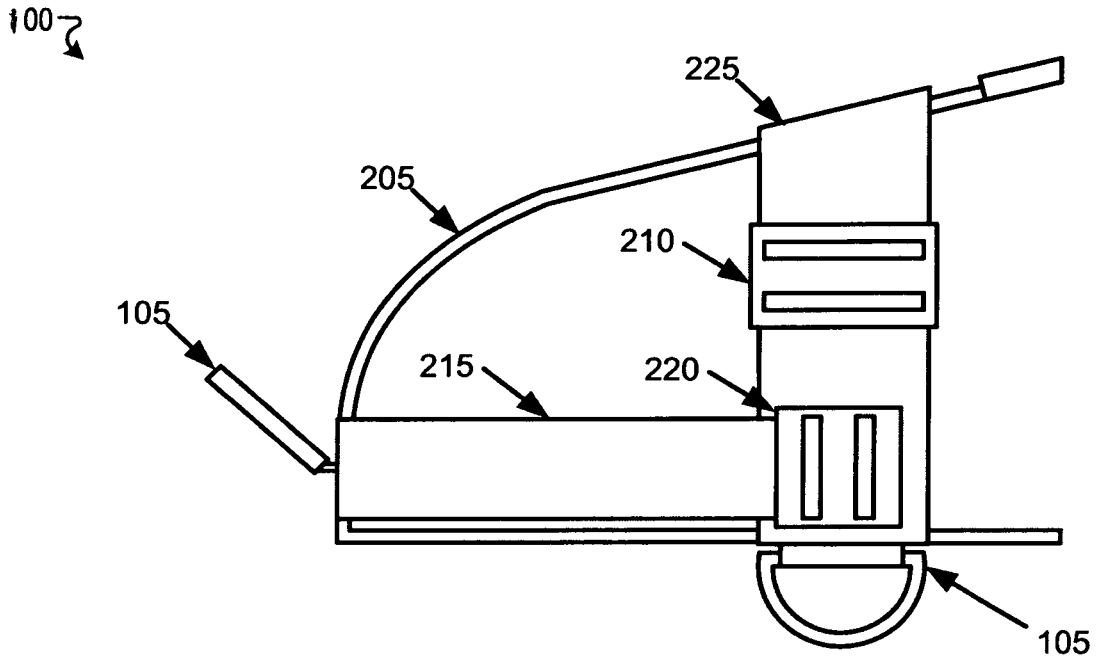
FIG. 2A illustrates a side profile view of the left side of the toe portion of the footwear harness according to implementations of the present disclosure.

FIG. 2A illustrates a side profile view of the left side of the toe portion of the footwear harness 100 according to implementations of the present disclosure. The left side of the toe portion of the footwear harness 100 may include belts 205, 215, 225 that cover the toe portion of the footwear (not shown). Belt 205 may cover a front surface of the toe portion of the footwear from a bottom surface (also referred to as "sole" hereafter) of the footwear to the upper surface of the footwear. Belt 205 may be coupled to belt 225 above the upper surface of the footwear. In on implementation, belt 205 may be coupled to belt 225 by sewing belt 205 to belt 225. In other implementations, belt 205 may be coupled to belt 225 using a fastener or coupling, such as VELCRO, pins, snaps, adhesives, wraps or the like. Belt 215 may cover the left side of the toe portion of the footwear from the front surface of the toe portion of the footwear to the left side of the footwear. In one implementation, belt 215 may be coupled to belt 225 using an adjustable buckle 220. The adjustable buckle 220 may be used to increase or decrease the length of belt 215 around the toe portion of the footwear. Belt 225 may cover the left side of the toe portion of the footwear from the sole of the footwear to the upper surface of the footwear. Belt 225 may include an adjustable buckle 210 that may be used to increase or decrease the length of belt 225. The left side of the toe portion of the footwear harness 100 may also include coupling points 105, as previously discussed.

Figure 2B:
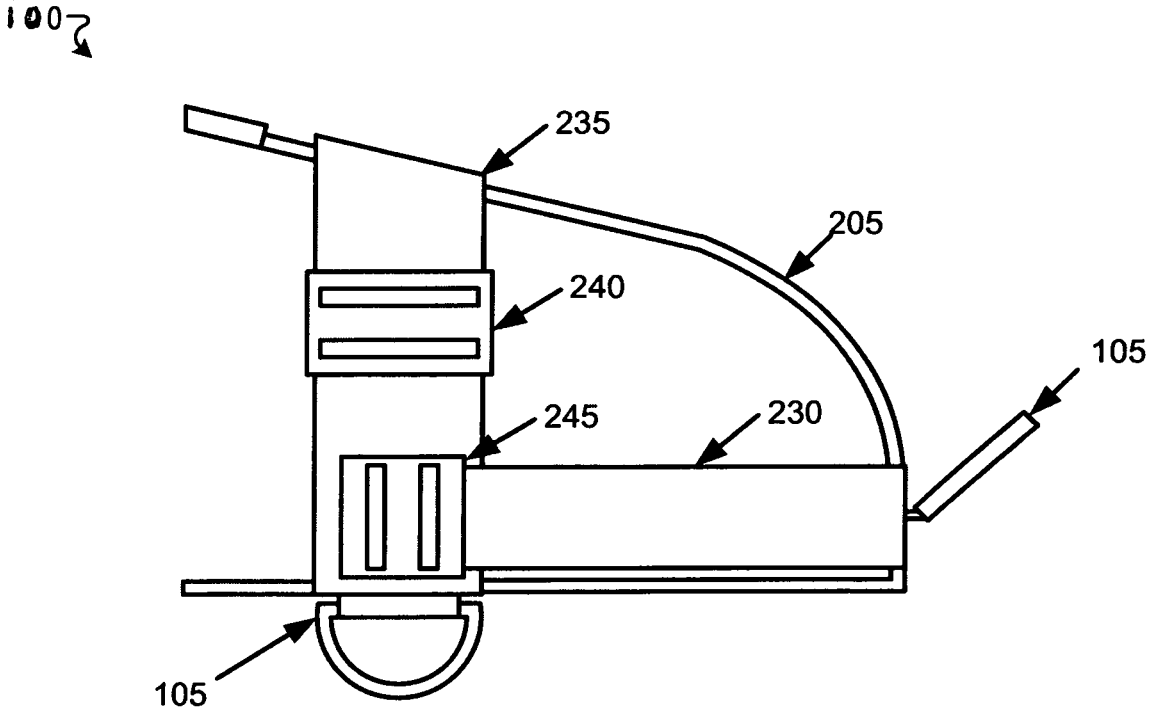
FIG. 2B illustrates a side profile view of the right side of the toe portion of the footwear harness according to implementations of the present disclosure.

FIG. 2B illustrates a side profile view of the right side of the toe portion of the footwear harness 100 according to implementations of the present disclosure. The right side of the toe portion of the footwear harness 100 may include belts 205, 230, 235 that cover the toe portion of the footwear (not shown). Belt 205 may cover a front surface of the toe portion of the footwear from the sole of the footwear to the upper surface of the footwear, as previously discussed. Belt 205 may be coupled to belt 235 above the upper surface of the footwear. In one implementation, belt 205 may be coupled to belt 235 by sewing belt 205 to belt 235. In other implementations, belt 205 may be coupled to belt 235 using a fastener or coupling, such as VELCRO, pins, snaps, adhesives, wraps or the like. Belt 230 may cover the right side of the toe portion of the footwear from the front surface of the toe portion of the footwear to the right side of the footwear. In one implementation, belt 230 may be coupled to belt 235 using an adjustable buckle 245. The adjustable buckle 245 may be used increase or decrease the length of belt 230 around the toe portion of the footwear. Belt 235 may cover the right side of the toe portion of the footwear from the sole of the footwear to the upper surface of the footwear. Belt 235 may include an adjustable buckle 240 that may be used to increase or decrease the length of belt 235. Page 10 of 23 the right side of the toe portion of the footwear harness 100 may also include coupling points 105, as previously discussed.

Figure 3A:
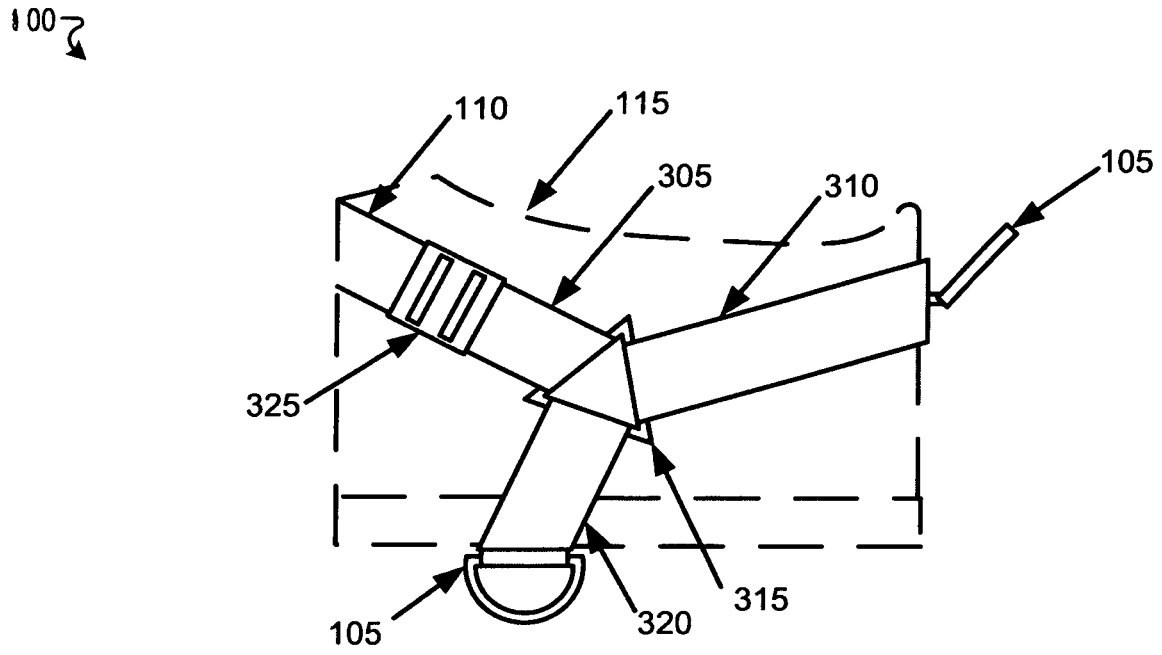
FIG. 3A illustrates a side profile view of the left side of the heel portion of the footwear harness according to implementations of the present disclosure.

FIG. 3A illustrates a side profile view of the left side of the heel portion of the footwear harness 100 according to implementations of the present disclosure. The left side of the heel portion of the footwear harness 100 may include belts 305, 310, 320 that cover the heel portion of the footwear 115. Belt 305 may cover the left side of the footwear 115. Belt 305 may be coupled to top belts 110 via a coupling 325. In one implementation, the coupling 325 may be a buckle formed of plastic, metal, metal alloys or other similar materials. In other implementations, the coupling 325 may be another type of fastener including, but not limited to, snaps, VELCRO, pins, clips or the like. In implementations, the coupling 325 may be used to increase or decrease the length of belt 110 and/or belt 305. Belt 305 may be coupled to belts 310, 320 by a coupling 315. In one implementation, the coupling 315 may be a triangular loop to which belts 305, 310, 320 may be attached. The coupling 315 may be formed of plastic, metal, metallic alloys or other similar materials. In other implementations, the coupling 315 may be a circular or elliptical loop. In further implementations, the coupling 315 may be another type of fastener including, but not limited to, snaps, VELCRO, pins, clips or the like. Belt 310 may cover the left side of the heel portion of the footwear from the left side of the heel portion of the footwear 115 to the rear surface of the footwear 115. Belt 320 may cover the left side of the heel portion of the footwear 115 from the sole of the footwear 115 to the left side of the footwear 115. The left side of the heel portion of the footwear harness 100 may also include coupling points 105, as previously discussed.

Figure 3B:
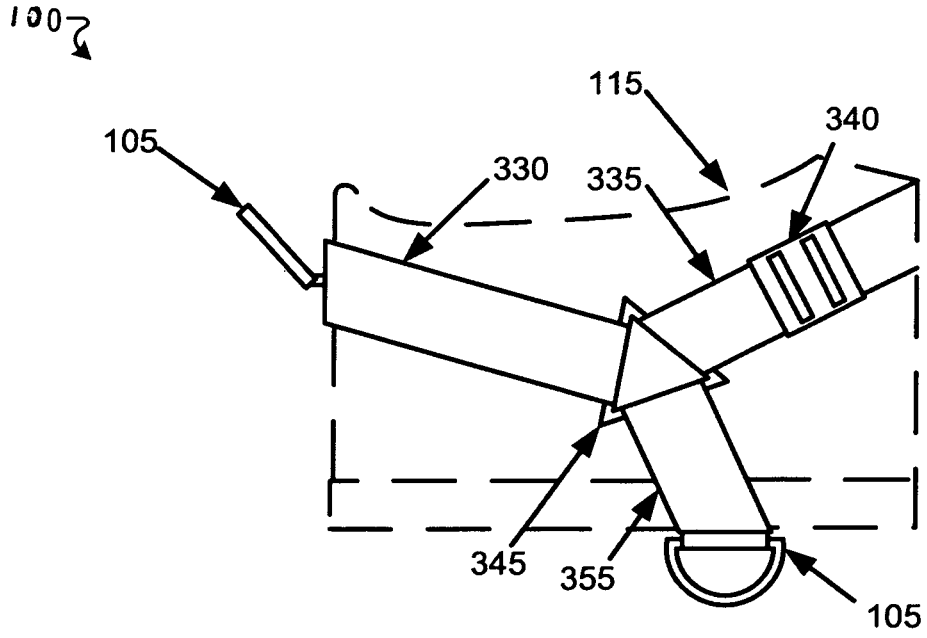
FIG. 3B illustrates a side profile view of the right side of the heel portion of the footwear harness according to implementations of the present disclosure.

FIG. 3B illustrates a side profile view of the right side of the heel portion of the footwear harness 100 according to implementations of the present disclosure. The right side of Page 11 of 23 the heel portion of the footwear harness 100 may include belts 330, 335, 355 that cover the heel portion of the footwear 115. Belt 335 may cover the right side of the footwear 115. Belt 335 may be coupled to top belts 110 via a coupling 340. In one implementation, the coupling 340 may be a buckle formed of plastic, metal, metal alloys or other similar materials. In other implementations, the coupling 340 may be another type of fastener including, but not limited to, snaps, VELCRO, pins, clips or the like. In implementations, the coupling 340 may be used to increase or decrease the length of belt 110 and/or belt 335. Belt 335 may be coupled to belts 330, 355 by a coupling 345. In one implementation, the coupling 345 may be a triangular loop to which belts 305, 310, 320 may be attached. The coupling 345 may be formed of plastic, metal, metal alloys or other similar materials. In other implementations, the coupling 345 may be a circular or elliptical loop. In further implementations, the coupling 345 may be another type of fastener including, but not limited to, snaps, VELCRO, pins, clips or the like. Belt 330 may cover the right side of the heel portion of the footwear from the right side of the heel portion of the footwear 115 to the rear surface of the footwear 115. Belt 355 may cover the right side of the heel portion of the footwear 115 from the sole of the footwear 115 to the right side of the footwear 115. The right side of the heel portion of the footwear harness 100 may also include coupling points 105, as previously discussed.

Figure 4:
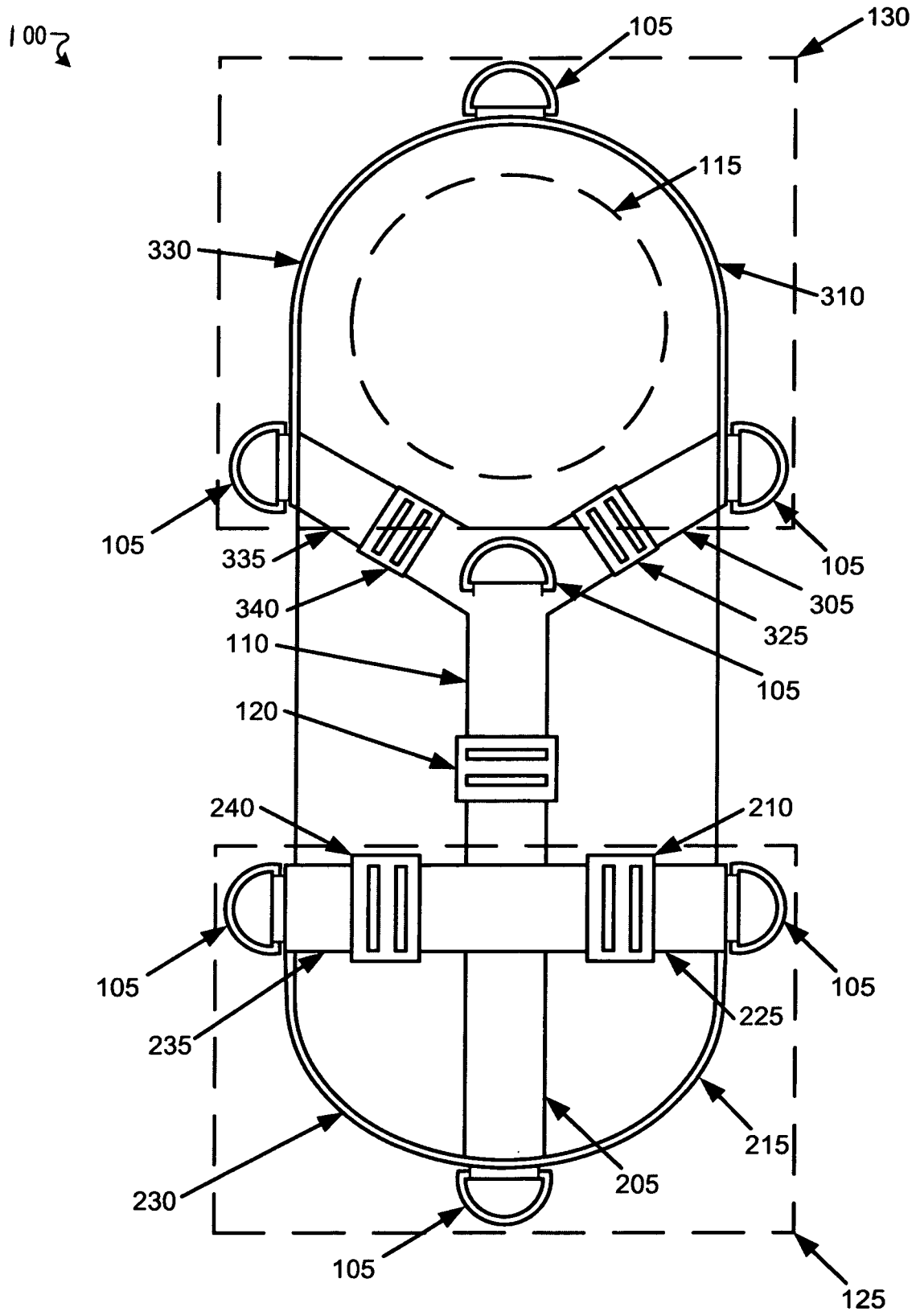
FIG. 4 illustrates a top down view of the footwear harness being worn on footwear according to implementations of the present disclosure.

FIG. 4 illustrates a top down view of the footwear harness 100 being worn on footwear 115 according to implementations of the present disclosure. The footwear harness 100 may include a toe portion 125 that includes adjustable buckles 210, 240 and belts 205, 215, 225, 230, 235 as previously discussed in FIGS. 2A and 2B. In one implementation, the toe portion 125 may also include coupling points 105 located at the front of the toe portion 125 and on each side of the toe portion 125. In some implementations, additional coupling points 105 may be included Page 12 of 23 at various positions in the toe portion 125. In other implementations, the toe portion 125 may include less coupling points 105. The footwear harness 100 may also include a heel portion 130 that includes belts 305, 310, 330, 335 as previous discussed in FIGS. 3A and 3B. The heel portion 130 may also include coupling points 105 located at the rear of the heel portion 130 and on each side of the heel portion 130. In some implementations, additional coupling points 105 may be included at various positions in the heel portion 130. In other implementations, the heel portion 130 may include less coupling points 105. The footwear harness 100 may also include top belts 110 that couple the toe portion 125 to the heel portion 130. The top belts 110 may include an adjustable buckle 120 to increase or decrease the length of top belts 110. The top belts 110 may be coupled to the heel portion 130 by couplings 325, 340 as previously discussed in FIGS. 3A and 3B.

Figure 5:
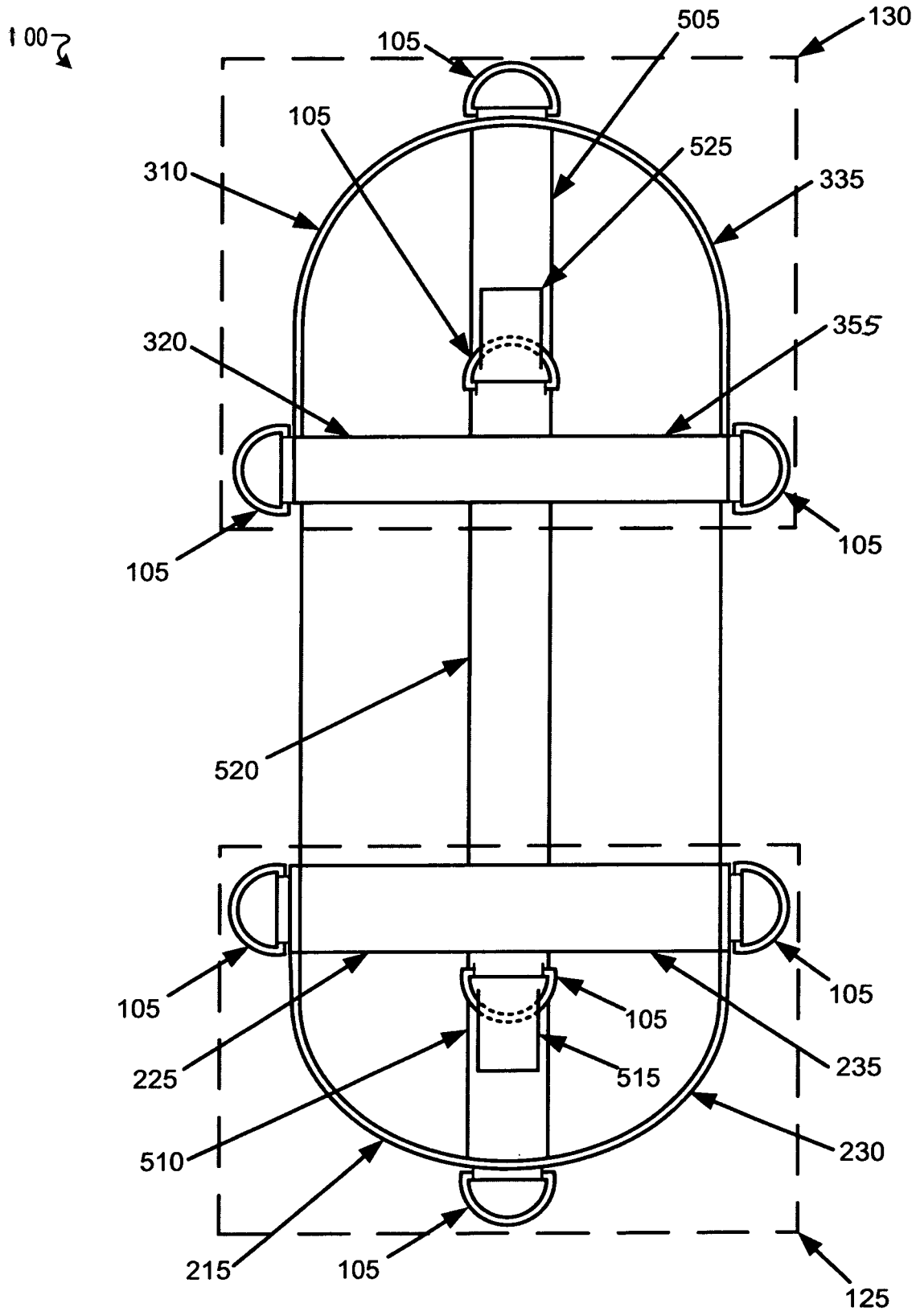
FIG. 5 illustrates a bottom up view of the footwear harness being worn on footwear according to implementations of the present disclosure.

FIG. 5 illustrates a bottom up view of the footwear harness 100 being worn on footwear according to implementations of the present disclosure. The footwear harness 100 may include a toe portion 125 that includes belts 215, 225, 230, 235 as previously discussed in FIGS. 2A and 2B. The toe portion 125 may also include belt 510 that is positioned below the sole of the footwear from the front surface of the toe portion 125 to belts 225, 235. In one implementation, belt 510 may be coupled to belts 225, 235 using a fastener such as VELCRO, pins, snaps, adhesives, wraps or the like. In other implementations, belt 510 may be coupled to belts 225, 235 by sewing belts 510, 225, 235 together or using any similar method. Belt 510 may include a coupling point 105 and a fastener 515 to secure coupling point 105. In implementations, fastener 515 may be a strip of material similar to belt 515 with VELCRO to secure fastener 515 to belt 510. In other implementations, fastener 515 may be another type of fastener including, but not limited to, snaps, adhesives, wraps or the like. In one implementation, the toe portion 125 may also include Page 13 of 23 coupling points 105 located at the front of the toe portion 125 and on each side of the toe portion 125. In some implementations, additional coupling points 105 may be included at various positions in the toe portion 125. In other implementations, the toe portion 125 may include less coupling points 105.

The footwear harness 100 may also include a heel portion 130 that includes belts 310, 320, 335, 350 as previous discussed in FIGS. 3A and 3B and belt 505 that is coupled to belts 320, 350 under the sole of the footwear and coupled to belts 310, 335 on the rear of the heel portion 130. Belt 505 may include a coupling point 105 and a fastener 525 to secure coupling point 105. In implementations, fastener 525 may be a strip of material similar to belt 505 with VELCRO to secure fastener 515 to belt 510. In other implementations, fastener 525 may be another type of fastener including, but not limited to, snaps, adhesives, wraps or the like. The heel portion 130 may also include coupling points 105 located at the rear of the heel portion 130 and on each side of the heel portion 130. In some implementations, additional coupling points 105 may be included at various positions in the heel portion 130. In other implementations, the heel portion 130 may include less coupling points 105. The footwear harness 100 may also include belt 520 that couples the toe portion 125 to the heel portion 130. In one implementation, belt 520 may be coupled to the toe portion 125 and the heel portion 130 using a fastener such as VELCRO, pins, snaps, adhesives, wraps or the like. In other implementations, belt 520 may be coupled to the toe portion 125 and the heel portion 130 by sewing belt 520 to the toe portion 125 and the heel portion 130, or using any similar method.

Figure 6:
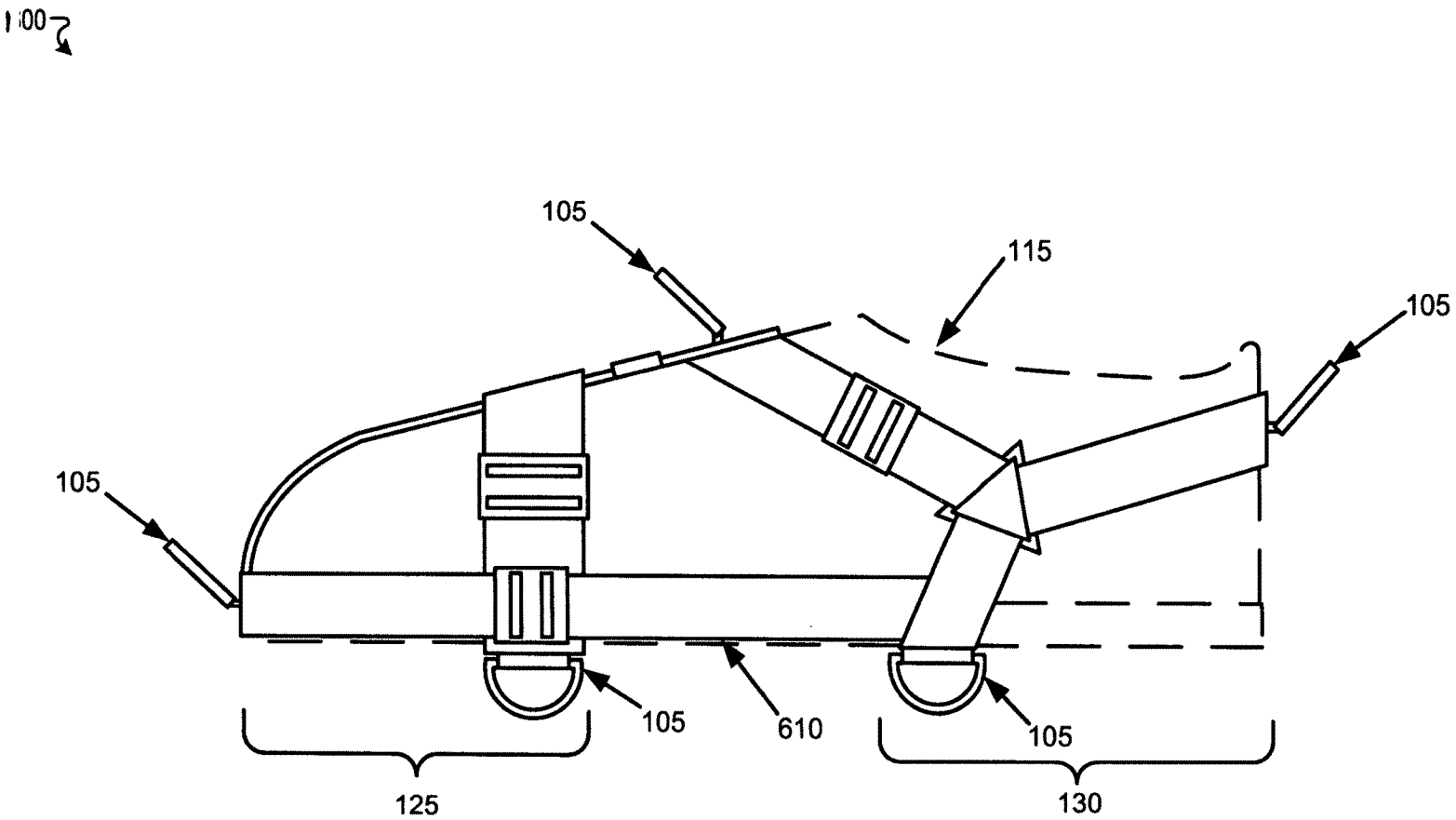
FIG. 6 illustrates a side profile view of footwear harness according to another implementation of the present disclosure.

FIG. 6 illustrates a side profile view of footwear harness 100 according to another implementation of the present disclosure. For illustration purposes, footwear harness 100 is shown as being worn on footwear 115. The footwear harness 100 may include coupling points Page 14 of 23 105 at various locations on the footwear harness 100. The coupling points 105 may facilitate the coupling of a resistance band or other exercise equipment to the footwear harness 100. In one implementation, the coupling points 105 may be loops. In another implementation, the coupling points 105 may be hooks. In other implementations, the coupling points 105 may be clips. The coupling points 105 may be fabricated from plastic, metal, metal alloys, carbon fiber or other similar materials. The footwear harness 100 may also include belt 610 that runs along the left side of the footwear 115 to couple the toe portion 125 of the footwear to the heel portion 130 of the footwear. A similar belt (not shown) may run along the right side of the footwear 115 to couple the toe portion 125 of the footwear to the heel portion 130 of the footwear.

Figure 7:
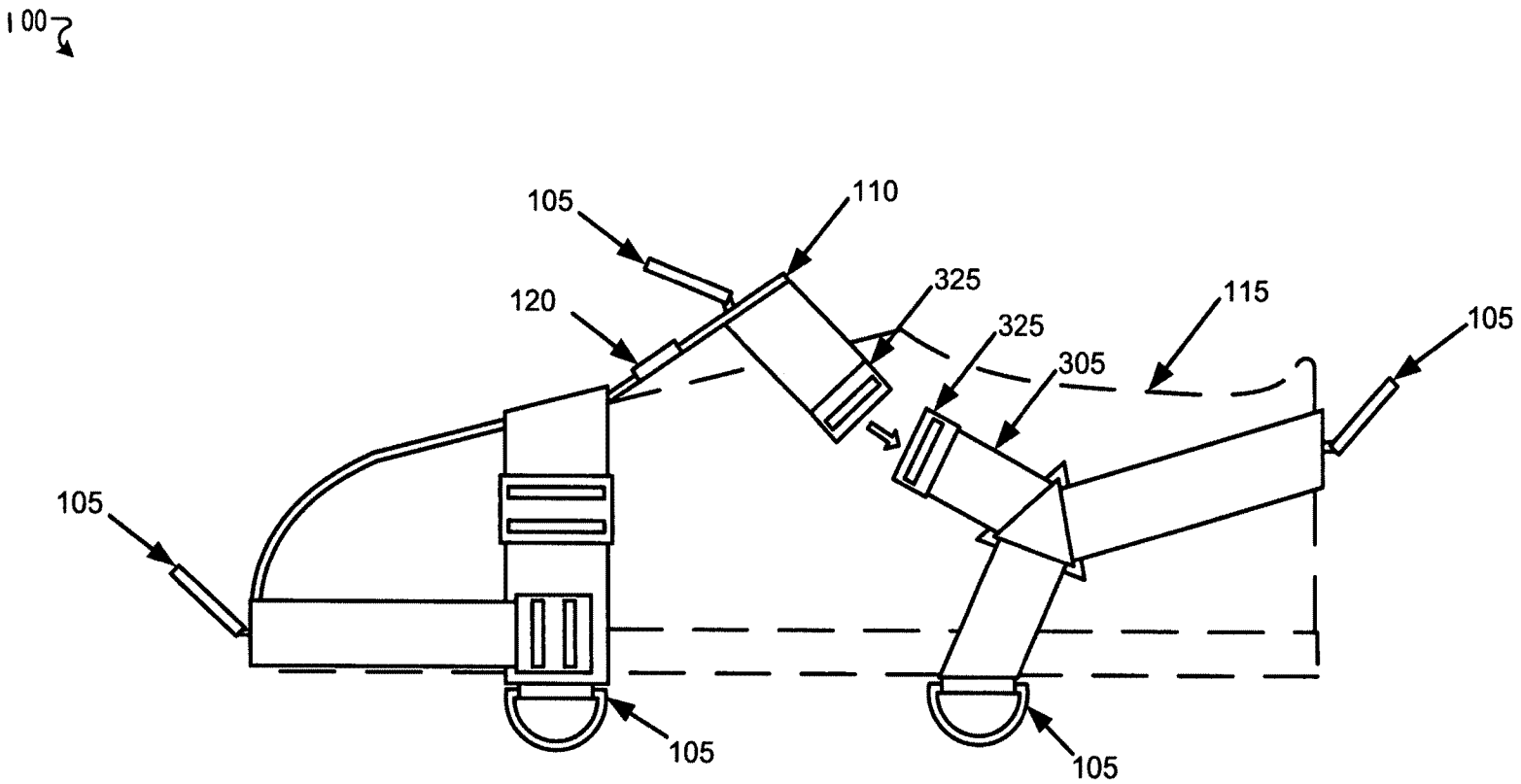
FIG. 7 illustrates a side profile view of securing the footwear harness over footwear according to implementations of the present disclosure.

FIG. 7 illustrates a side profile view of securing the footwear harness 100 over footwear 115 according to implementations of the present disclosure. For illustration purposes, footwear harness 100 is shown as being worn on footwear 115. The footwear harness 100 may include coupling points 105 at various locations on the footwear harness 100. The footwear harness 700 may be secured over the footwear 115 using coupling 325 to couple the top belt 110 to belt 305.

Figure 8A:
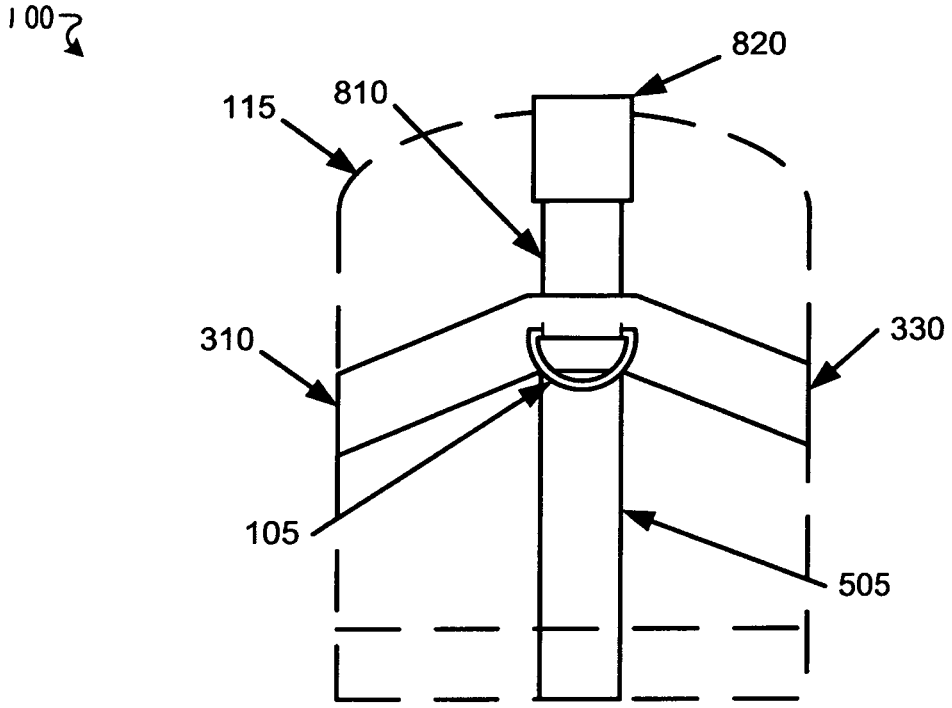
FIG. 8A illustrates a rear view of the heel portion of the footwear harness with a heel fastener according to implementations of the present disclosure.
Figure 8B:
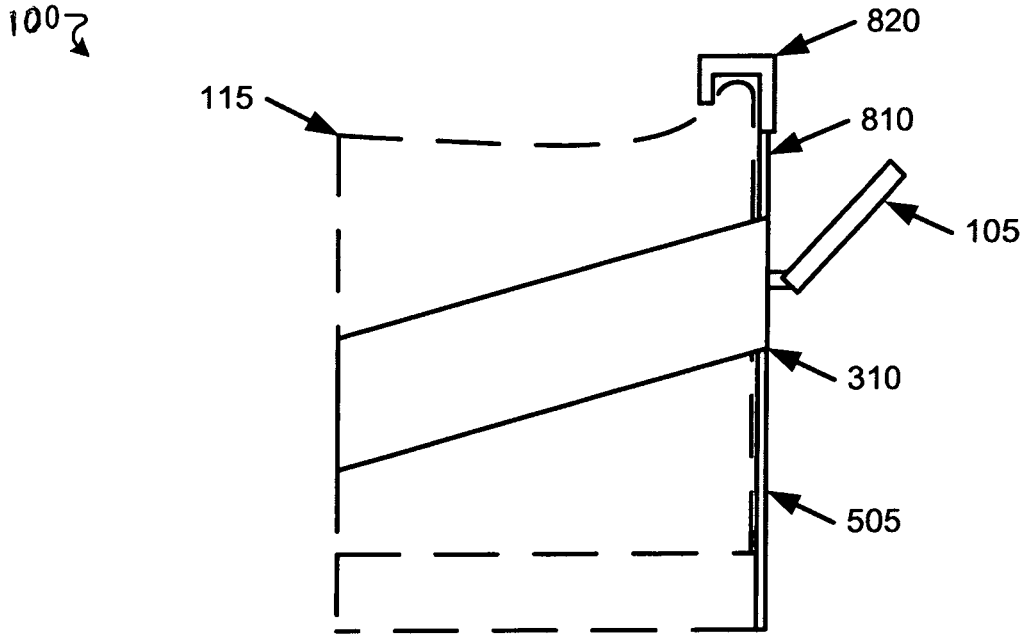
FIG. 8B illustrates a side profile view of the footwear harness with a heel fastener according to implementations of the present disclosure.

FIG. 8A illustrates a rear view of the heel portion of the footwear harness 100 with a heel fastener according to implementations of the present disclosure. The heel portion may include belts 310, 330, 505 and coupling point 105. The heel portion may further include belt 810 that is coupled to belts 310, 330 and fastener 820. Fastener 820 may couple to the top of the heel of the footwear 115 to hold the footwear harness 100 in place during use. FIG. 8B illustrates a side profile view of the footwear harness 100 with a heel fastener. As previously discussed, fastener 820 is coupled to the top of footwear 115 to prevent the heel portion of the footwear harness 100 from sliding down during use. Fastener 820 may be any sort of fastener capable of Page 15 of 23 coupling to the top of the heel portion of footwear 115, including, but not limited to, adhesive, pins, hooks, VELCRO, snaps or the like.

In the foregoing description, numerous details are set forth. It will be apparent, however, to one of ordinary skill in the art having the benefit of this disclosure, that the disclosure may be practiced without these specific details. In some instances, well-known structures and devices are shown in block diagram form, rather than in detail, in order to avoid obscuring the disclosure.

The words "example" or "exemplary" or "instance" are used herein to mean serving as an example, instance, or illustration. Any aspect or design described herein as "example' or "exemplary" or "instance" is not necessarily to be construed as preferred or advantageous over other aspects or designs. Rather, use of the words "example" or "exemplary" or "instance" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims may generally be construed to mean "one or more" unless specified otherwise or clear from context to be directed to a singular form. Moreover, use of the term "an implementation" or "one implementation" or "an implementation" or "one implementation" throughout is not intended to mean the same implementation or implementation unless described as such. The terms "first," "second," "third," "fourth," etc. as used herein are meant as labels to distinguish among different elements and may not necessarily have an ordinal meaning according to their numerical designation.

It is to be understood that the above description is intended to be illustrative, and not restrictive. Other implementations will be apparent to those of skill in the art upon reading and understanding the above description. The scope of the disclosure may, therefore, be determined with reference to the appended claims, along with the full scope of equivalents to which such claims are entitled.

What is claimed is:

1. A harness to be placed over footwear, the harness comprising:

a toe portion to be placed around a toe of the footwear, the toe portion comprising:

a first plurality of belts to cover the toe of the footwear from a sole of the footwear to an upper surface of the footwear;

a first coupling point located on a first side of the toe portion;

a second coupling point located on a second side of the toe portion; and a third coupling point located on a front surface of the toe portion;

a heel portion to be placed around a heel of the footwear, the heel portion comprising:

a second plurality of belts to cover the heel of the footwear from the sole of the footwear to the upper surface of the footwear;

the second plurality of belts comprises:

a first belt to cover the first side of the heel portion, the sole of the footwear, and the second side of the heel portion;

a second belt to cover the first side of the heel portion, the rear surface of the heel of the footwear, and the second side of the heel portion; and a third belt and a fourth belt to collectively cover the first side of the heel portion, the upper surface of the footwear, and the second side of the heel portion, wherein the first belt, the second belt, the third belt, and the fourth belt are coupled by a first coupling positioned at the first side of the heel portion and by a second coupling positioned at the second side of the heel portion, a fourth coupling point located on a first side of the heel portion;

a fifth coupling point located on a second side of the heel portion; and a sixth coupling point located on a rear surface of the heel portion;

a bottom belt that runs along the sole of the footwear and couples the toe portion to the heel portion; and a plurality of top belts that run along the upper surface of the footwear, the plurality of top belts being configured to couple the toe portion to the heel portion, wherein the plurality of top belts comprise a seventh coupling point located on a belt of the plurality of top belts that is above the upper surface of the footwear.

2. The harness of claim 1, wherein the first plurality of belts comprises:

a fifth belt to cover the front surface of the toe portion from the sole of the footwear to the upper surface of the footwear;

a sixth belt to cover the first side of the toe portion from the sole of the footwear to the upper surface of the footwear; and a seventh belt to cover the second side of the toe portion from the sole of the footwear to the upper surface of the footwear, wherein the fifth belt, the sixth belt, and the seventh belt are coupled by a third coupling located at the sole of the footwear and are coupled by a fourth coupling located above the upper surface of the footwear.

3. The harness of claim 2, wherein at least one of the fifth belt or the sixth belt comprises an adjustable buckle to adjust the at least one of the fifth belt or the sixth belt relative to the footwear.

4. The harness of claim 1, wherein the first coupling and the second coupling are configured to couple the first belt, the second belt, the third belt, and the fourth belt, wherein the first coupling and the second coupling each comprise a triangular loop.

5. The harness of claim 1, wherein the plurality of top belts comprise at least one coupling configured to couple the toe portion to the heel portion.

6. The harness of claim 5, wherein the at least one coupling configured to couple the toe portion to the heel portion comprises a buckle.

7. The harness of claim 1, further comprising:

a first side belt that runs along a first side of the footwear and is configured to couple the toe portion to the heel portion; and a second side belt that runs along a second side of the footwear and is configured to couple the toe portion to the heel portion.

8. The harness of claim 1, wherein each of the coupling points comprises at least one of a hook, a loop, or a clip.

9. The harness of claim 1, further comprising:

a heel belt coupled to the heel portion and comprising a fastener configured to couple to an upper surface of the heel of the footwear.

10. The harness of claim 1, wherein the first plurality of belts comprises:

an adjustable buckle coupled to a respective belt of the plurality of belts that facilitates an adjustment of the respective belt relative to the footwear.

11. A footwear apparatus to facilitate different exercises for a wearer of the footwear apparatus, the footwear apparatus comprising:

a toe portion for a toe of footwear, the toe portion comprising a first plurality of belts;

a heel portion for a heel of the footwear, the heel portion comprising a second plurality of belts;

at least one belt to couple the toe portion and the heel portion; and a plurality of coupling points at locations on the toe portion and the heel portion to facilitate the different exercises for the wearer of the footwear apparatus, the second plurality of belts comprises:

a first belt to cover a first side of the heel portion, a sole of the footwear, and a second side of the heel portion;

a second belt to cover the first side of the heel portion, a rear surface of the heel of the footwear, and the second side of the heel portion; and a third belt and a fourth belt to collectively cover the first side of the heel portion, the upper surface of the footwear, and the second side of the heel portion, wherein the first belt, the second belt, the third belt, and the fourth belt are coupled by a first coupling positioned at the first side of the heel portion and by a second coupling positioned at the second side of the heel portion.

12. The footwear apparatus of claim 11, wherein the first plurality of belts comprises:

a fifth belt to cover a front surface of the toe portion from the sole of the footwear to an upper surface of the footwear;

a sixth belt to cover a first side of the toe portion from the sole of the footwear to the upper surface of the footwear; and a seventh belt to cover a second side of the toe portion from the sole of the footwear to the upper surface of the footwear, wherein the fifth belt, the sixth belt, and the seventh belt are coupled by a third coupling located at the sole of the footwear and are coupled by a fourth coupling located above the upper surface of the footwear.

13. The footwear apparatus of claim 11, wherein the first coupling and the second coupling are configured to couple the first belt, the second belt, the third belt, and the fourth belt, wherein the first coupling and the second coupling each comprise a triangular loop.

14. The footwear apparatus of claim 11, wherein the at least one belt to couple the toe portion and the heel portion comprises at least one coupling configured to couple the toe portion to the heel portion.

15. The footwear apparatus of claim 11, wherein the at least one belt to couple the toe portion to the heel portion comprises:

a first side belt that runs along a first side of the footwear and is configured to couple the toe portion to the heel portion; and a second side belt that runs along a second side of the footwear and is configured to couple the toe portion to the heel portion.

16. The footwear apparatus of claim 11, wherein the plurality of coupling points comprises at least one of a hook, a loop, or a clip.

17. The footwear apparatus of claim 11, further comprising:

a heel belt coupled to the heel portion and comprising a fastener configured to couple to an upper surface of the heel of the footwear.

18. The footwear apparatus of claim 11, wherein the at least one belt to couple the toe portion to the heel portion comprises:

an adjustable buckle coupled to the at least one belt that facilitates an adjustment of the at least one belt relative to the footwear.

* * * * *